US009755371B2

(12) United States Patent
Zhao et al.

(10) Patent No.: US 9,755,371 B2
(45) Date of Patent: Sep. 5, 2017

(54) ELECTRICAL CONNECTOR WITH THIN CONDUCTIVE FILM BETWEEN TWO ROWS OF CONTACTS

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/401,121

(22) Filed: Jan. 9, 2017

(65) Prior Publication Data

US 2017/0201046 A1 Jul. 13, 2017

(30) Foreign Application Priority Data

Jan. 8, 2016 (CN) ..... 2016 1 0010147

(51) Int. Cl.
*H01R 13/66* (2006.01)
*H01R 13/6585* (2011.01)
(Continued)

(52) U.S. Cl.
CPC ..... *H01R 13/6585* (2013.01); *H01R 13/26* (2013.01); *H01R 13/405* (2013.01);
(Continued)

(58) Field of Classification Search
CPC H01R 13/6658; H01R 85/2045; H01R 13/22; H01R 23/7073
(Continued)

(56) References Cited

U.S. PATENT DOCUMENTS

2015/0263473 A1* 9/2015 Guo ..... H01R 13/633 439/571
2016/0233594 A1* 8/2016 Zhao ..... H01R 13/6581
(Continued)

FOREIGN PATENT DOCUMENTS

CN 203859275 10/2014
CN 204205153 3/2015

OTHER PUBLICATIONS

Universal Serial Bus Type-C Cable and Connector Specification, Reversion 1.2, Mar. 24, 2016, p. 1,31-33, 52,53.

*Primary Examiner* — Phuongchi T Nguyen

(74) *Attorney, Agent, or Firm* — Wei Te Chung; Ming Chieh Chang

(57) ABSTRACT

The electrical connector includes an insulative housing, a plurality of upper/first contacts and lower/second contacts retained in the housing, a reinforcement piece located between the upper contacts and the lower contacts in the vertical direction, and a metallic shield enclosing the housing. The housing includes a first insulator carrying the first contacts with a first tongue thereof, and a second insulator carrying the second contacts with a second tongue thereof, and the reinforcement piece is located between the first insulator and the second insulator wherein the reinforcement piece includes a relatively thin conductive film or layer located between the first mating tongue and the second mating tongue in the vertical direction.

20 Claims, 8 Drawing Sheets

(51) Int. Cl.

| | |
|---|---|
| ***H01R 24/60*** | (2011.01) |
| ***H01R 13/26*** | (2006.01) |
| ***H01R 13/405*** | (2006.01) |
| ***H01R 13/502*** | (2006.01) |
| ***H01R 13/6598*** | (2011.01) |
| ***H01R 43/24*** | (2006.01) |
| ***H01R 43/18*** | (2006.01) |
| *H01R 107/00* | (2006.01) |

(52) U.S. Cl.
CPC ..... *H01R 13/502* (2013.01); *H01R 13/6598* (2013.01); *H01R 24/60* (2013.01); *H01R 43/18* (2013.01); *H01R 43/24* (2013.01); *H01R 2107/00* (2013.01)

(58) Field of Classification Search
USPC ..... 439/620.1–620.34, 289, 79
See application file for complete search history.

(56) References Cited

U.S. PATENT DOCUMENTS

| | | | | |
|---|---|---|---|---|
| 2016/0294105 | A1* | 10/2016 | Zhao | H01R 13/5202 |
| 2016/0359274 | A1* | 12/2016 | Zhang | H01R 43/24 |
| 2016/0372870 | A1* | 12/2016 | Guo | H01R 24/60 |

* cited by examiner

ELECTRICAL CONNECTOR WITH THIN CONDUCTIVE FILM BETWEEN TWO ROWS OF CONTACTS

BACKGROUND OF THE INVENTION

1. Field of the Invention

The present invention relates to an electrical connector, and particularly to a flippable connector and the method of making the same.

2. Description of Related Arts

Chinese Patent No. CN204205153U issued on Mar. 11, 2015, discloses a flippable connector including an insulative housing, a plurality of contacts, a metallic shield and a metallic shielding/grounding/latching plate. The insulative housing includes opposite upper and lower insulators with the shielding plate located therebetween. An middle insulator encloses the shielding plate and is physically sandwiched between the upper insulator and the lower insulator. Chinese Patent No. CN203859275 issued on Oct. 1, 2014, discloses a flippable connector including a mating unit, a metallic shielding plate and a metallic shield. The mating unit includes a first terminal module and a second terminal module with the shielding plate physically sandwiched therebetween.

Understandably, the crosstalk between the contacts of the upper terminal module and those of the lower terminal module may be eliminated by the shielding plate, thus reducing EMI (Electro-Magnetic Interference) and improving the high frequency transmission. Anyhow, on one hand, the distance between the shielding plate and the corresponding upper/lower contacts is relatively small, i.e., around 0.175 mm, so it tends to be shorted between the contact and the shielding plate if a power contact carriers a relatively high current for quick charging. On the other hand, because the contacts include a plurality of differential pairs for high frequency/speed transmission, it really requires the shielding plate to isolate the upper contacts and lower contacts from each other in the vertical direction. Therefore, it is desired to have a new type electrical connector overcoming the aforementioned deficiency.

SUMMARY OF THE INVENTION

Accordingly, an object of the present invention is to provide an electrical connector which is able to transmit both the high frequency signals and the high currently/voltage without shorting.

The electrical connector includes an insulative housing, a plurality of upper/first contacts and lower/second contacts retained in the housing, a reinforcement piece located between the upper contacts and the lower contacts in the vertical direction, and a metallic shield enclosing the housing. The housing includes a first insulator carrying the first contacts with a first tongue thereof, and a second insulator carrying the second contacts with a second tongue thereof, and the reinforcement piece is located between the first insulator and the second insulator wherein the reinforcement piece includes a relatively thin conductive film or layer located between the first mating tongue and the second mating tongue in the vertical direction. The first mating tongue and the second mating tongue commonly form a tongue portion of the housing. The first base and the second base commonly form a base portion of the housing. The conductive film is attached upon the inner surface of at least one of the first insulator and the second insulator. The housing further includes a third insulator applied upon the first insulator and the second insulator and the conductive film. The reinforcement piece further includes a pair of side arms located by two sides of the conductive film in the transverse direction. The thickness of the conductive film is much smaller than the thickness of the side arm so the distance between the side arm and the corresponding contact in the vertical direction is much smaller than that between the conductive film and the corresponding contact. Each side arm extends outwardly and sidewardly beyond a side edge of the tongue portion. The side arm includes a clipped arm, a securing arm and a connecting arm located therebetween and extending along an oblique direction.

The method of making the electrical connector includes the following steps: Step 1) providing a first terminal module with a plurality of first contacts retained in a first insulator via first stage insert-molding process; Step 2) providing a second terminal module with a plurality of second contacts retained in a second insulator via another first stage insert-molding process; Step 3) providing a metallic reinforcement piece between the first terminal module and the second terminal module in the vertical direction wherein the reinforcement piece includes a conductive film and a pair of side arms by two sides of the conductive film in the transverse direction; Step 4) providing a third insulator upon the first terminal module, the second terminal module and the reinforcement piece to form a complete terminal module assembly; Step 5) providing a metallic shield enclosing the terminal module assembly to form the complete connector.

The conductive reinforcement piece includes a very thin middle film structure confronting the corresponding high current power contacts and high frequency signal contacts in the vertical direction for both the shielding function and the relatively far distancing function, and the relatively rigid/thick side arms confront only the corresponding grounding contacts in the vertical direction without the shorting risk for latching/grounding function with the complementary plug connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
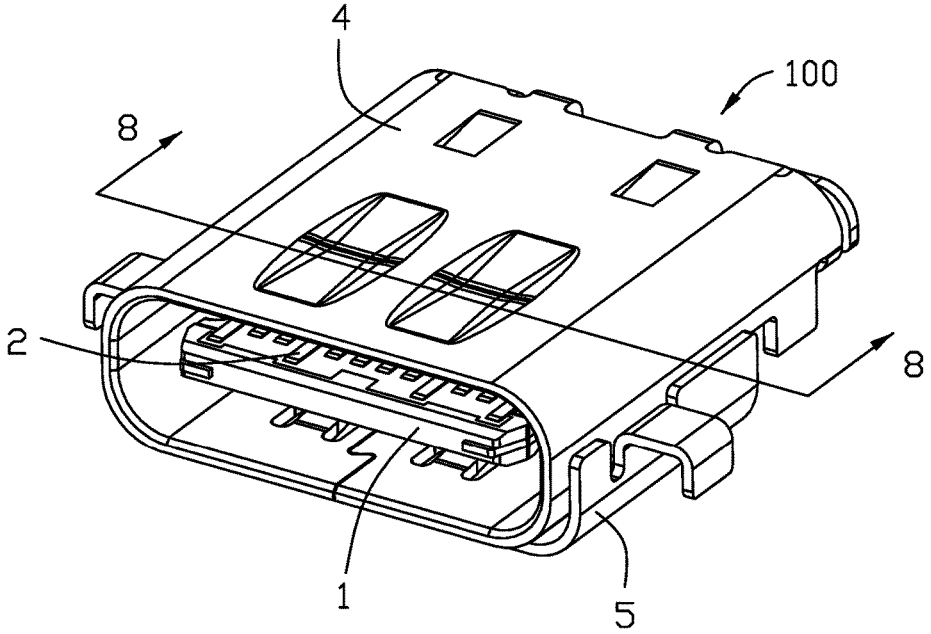
FIG. 1 is a perspective view of the electrical connector of the invention.

Reference will now be made in detail to some preferred embodiments of the present invention.

Referring to FIGS. 1-8, an electrical connector 100 includes an insulative housing 1, a plurality of contacts disposed in the housing 1, a plurality of contacts 2, a metallic reinforcement piece 3 embedded within the insulative housing 1, a metallic shield 4 enclosing the housing 1, a metallic bracket 5 mounted upon the shield 5 and a sealer 6 attached upon the housing 1. The following description refers to the mating direction, the transverse direction perpendicular to the mating direction, and a vertical direction perpendicular to both the mating direction and the transverse direction.

Referring to FIGS. 4-7, the insulative housing 1 includes a first insulator 11, a second insulator 12 and a third insulator 13. The first insulator includes a first base 111 and a first mating tongue 112 forwardly extending therefrom. The first base 111 forms the guiding slot 113 and an opening 114 communicating with the guiding slot 113. A pair of recesses 115 are formed in two opposite sides of the first base 111. An engaging hole 116 is formed in a front portion of the first mating tongue 112. A plurality of first fixing holes 117 and a plurality of first fixing posts 118 are formed upon a surface of the first mating tongue 112 facing the second insulator 12.

The second insulator 12 includes a second base 121 and a second mating tongue 122 extending forwardly therefrom. A pair of alignment blocks 123 are formed on two opposite sides of the second mating tongue 122. Another opening 124 is formed in the second base 121 corresponding the opening 114. A pair of projections 125 are located on the rear portion of the second base121 for engagement with the recesses 115. The second mating tongue 122 forms an engaging block 126 and extending into the corresponding engaging hole 116. A plurality of second fixing holes 127 for receiving the corresponding first fixing posts 118, and a plurality of second fixing posts 128 for extending into the corresponding first fixing holes 117, are formed upon a surface facing the second insulator 12. The alignment block 123 is located between the corresponding projection 125 and second fixing post 128.

The third insulator 13 includes a third base 131 and a third mating tongue 132 extending forwardly therefrom. The third mating tongue 132 includes a cavity 133 to receive the first mating tongue 112 and the second mating tongue 122, and a pair of locking notches 134 and two pairs of securing slots 135.

Referring to FIGS. 2-7, the contacts 2 includes a plurality of first contacts 21 retained in the first insulator 11, and a plurality of second contacts 22 retained in the second insulator 12. The first contact 21 includes the first contacting section 211 exposed upon the first mating tongue 112, an obliquely extending first retention section 212 disposed in the first base 111, and a first soldering section 213 extending out of the housing 1. The second contact 22 includes the second contacting section 221 exposed upon the second mating tongue 122, the second retention section 222, and a second soldering section 223 exposed outside of the housing 1. The second contacts 22 are equally located by two sides of the opening 124. The first soldering section 213 and the second soldering section 223 are coplanar with each other. Notably, the contacts 2 are characterized by following the USB (Universal Serial Bus) Type C specification.

The first contacts 21 and the second contacts 22 are diagonally symmetrically arranged with each other wherein in either the group of either the first contacts 21 and the second contacts 22, the first contact and the twelfth are the grounding contacts, the fourth and the ninth are the power contacts, the (differential) paired second and third and the paired tenth and eleventh are the high frequency signal contacts, the sixth and the seventh are the low frequency signal contacts. Notably, the first insulator 11 cooperates with the first contacts 21 to be a first terminal module (not labeled), and the second insulator 12 cooperates with the second contacts 22 to be a second terminal module (not labeled).

Figure 4:
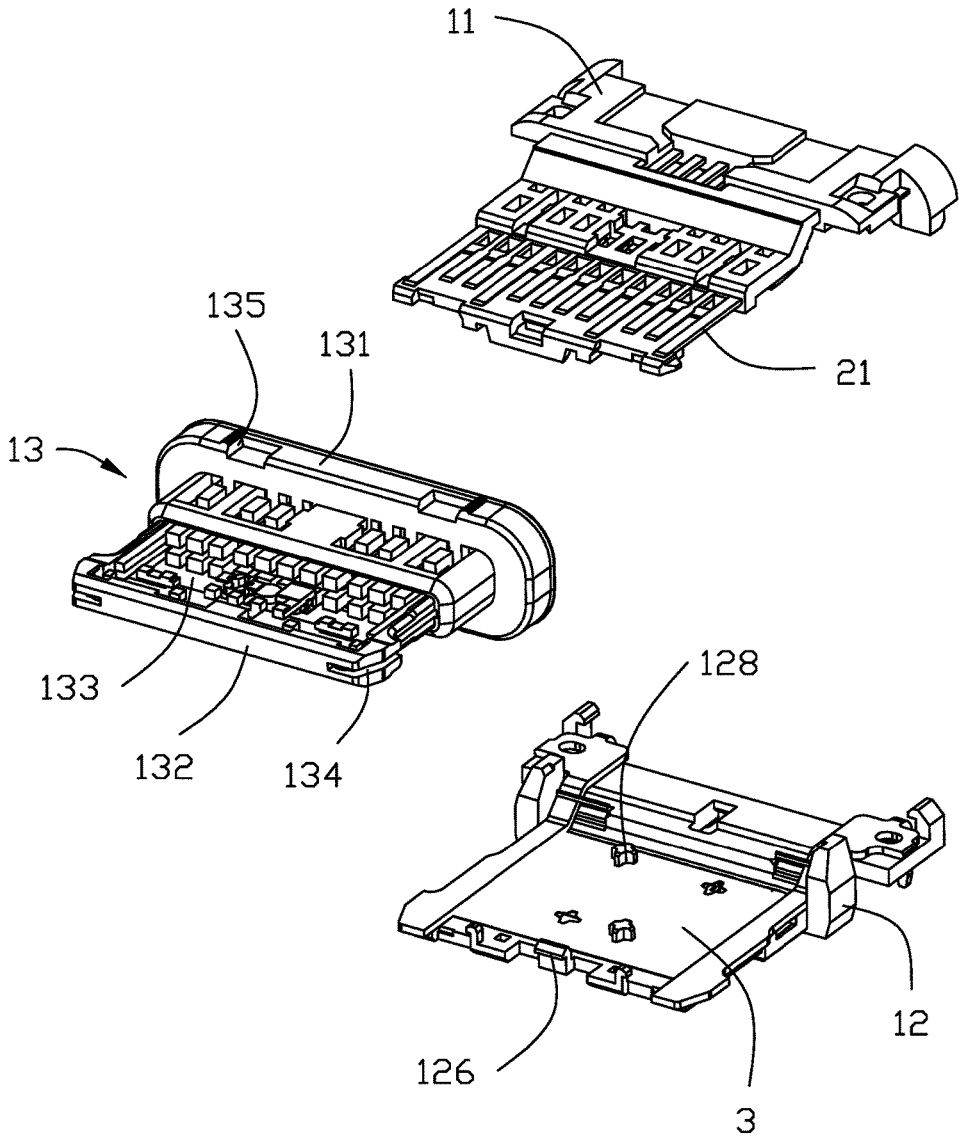
FIG. 4 is an exploded perspective view of the terminal module assembly of the electrical connector of FIG. 1 wherein the conductive film is assembled upon the second insulator.
Figure 5:
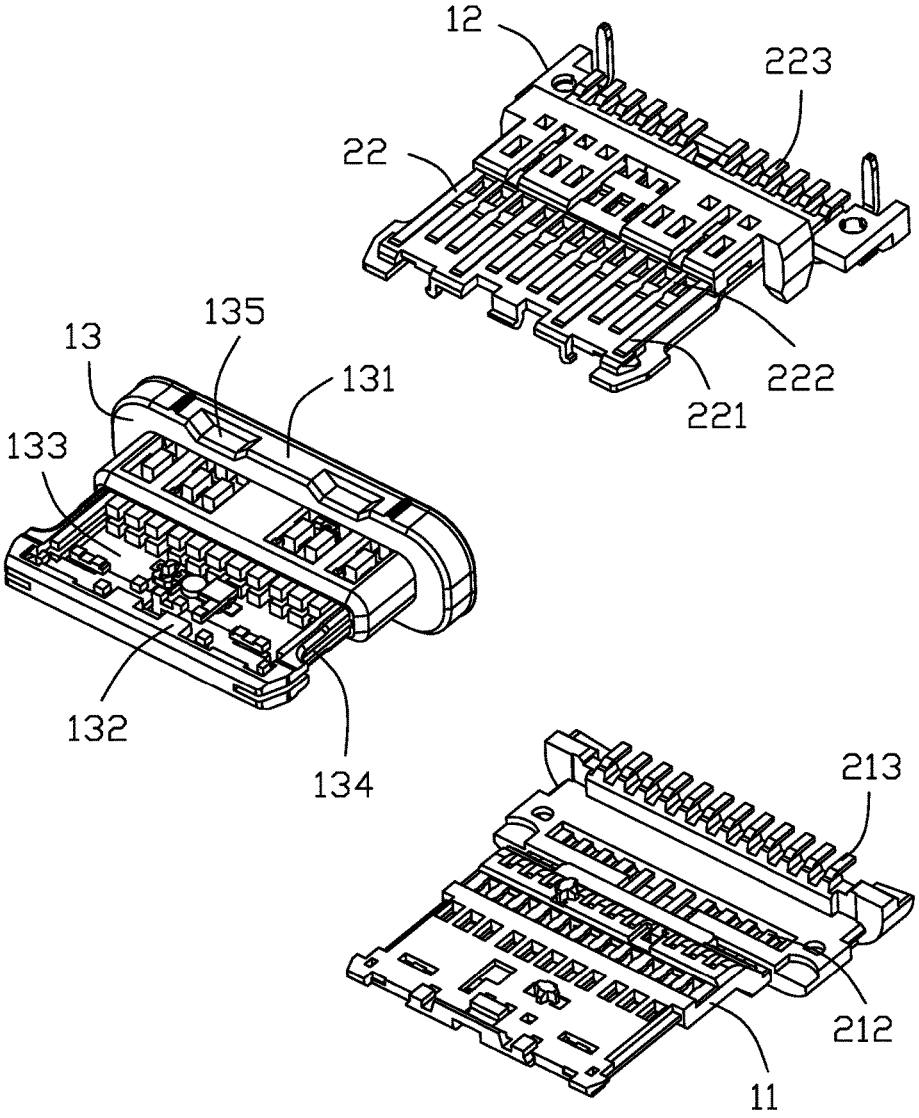
FIG. 5 is another exploded perspective view of the terminal module assembly of the electrical connector of FIG. 4.
Figure 6:
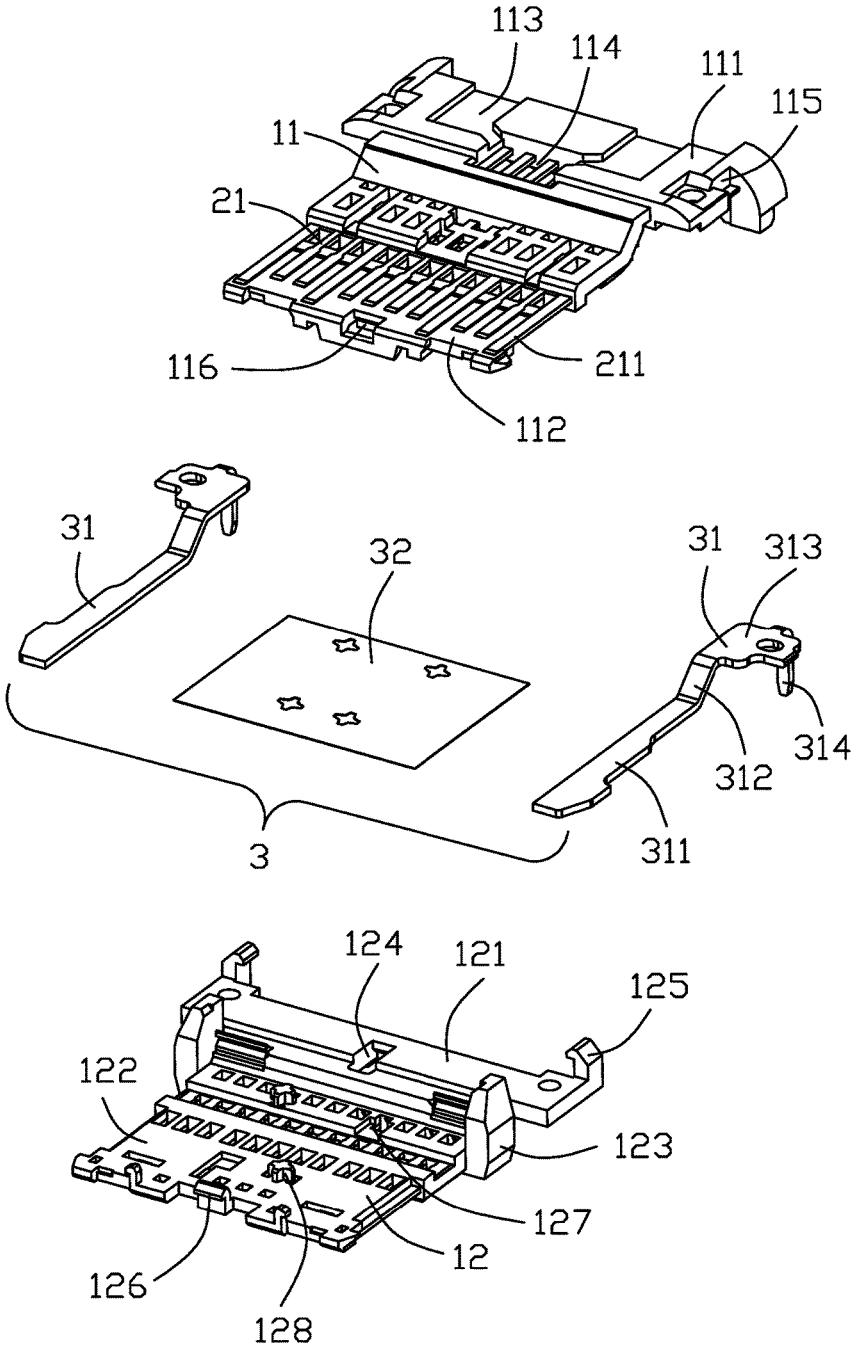
FIG. 6 is a further exploded perspective view of the terminal module assembly of the electrical connector of FIG. 4 wherein the reinforcement piece is taken away from the second insulator.
Figure 7:
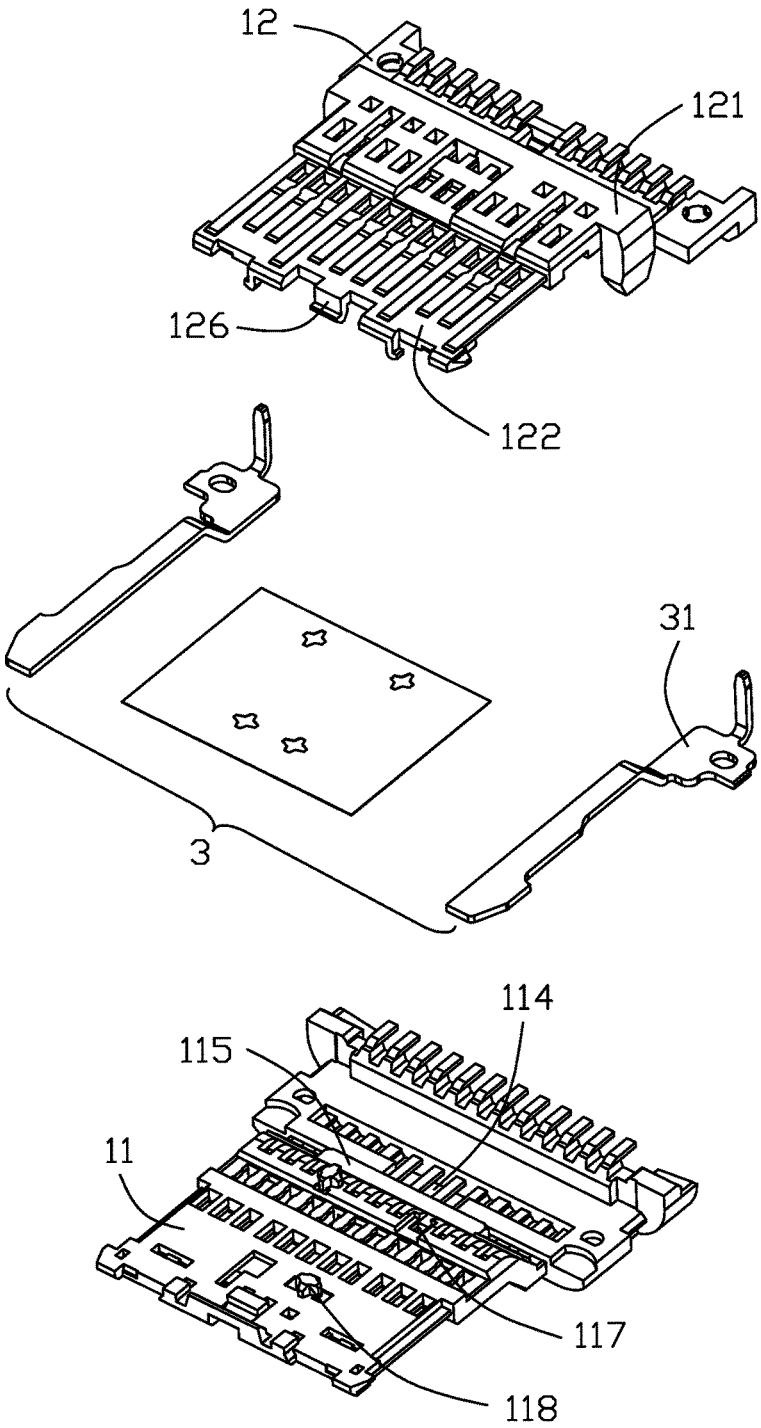
FIG. 7 is another further exploded perspective view of the terminal module assembly of the electrical connector of FIG. 6.
Figure 8:
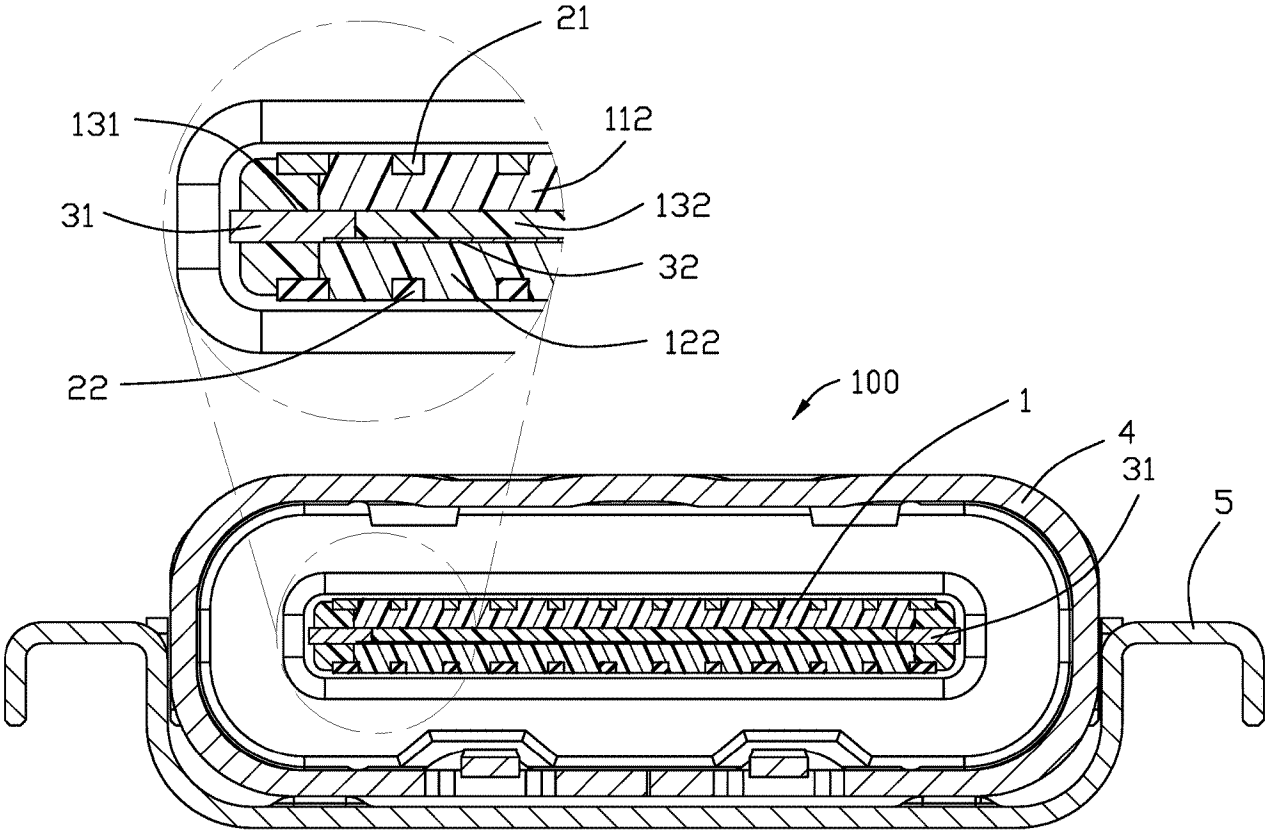
FIG. 8 is a cross-sectional view of the electrical connector of FIG. 1 to show how the conductive film is located among the neighboring parts.

Referring to FIGS. 6 and 7, the metallic reinforcement piece 3 includes a pair of metallic side arms 31 and a conductive film 32 located therebetween, i.e., the pair of side arms 31. Each side arm 31 includes a front latching arm 311, a middle oblique extending connecting arm 312, a rear retaining arm 313 and a downwardly extending soldering arm 314. The latching arm 311 and the connecting arm 312 are sandwiched between the first mating tongue 112 and the second mating tongue 122 with the latching edge exposed outside the tongue portion of the housing 1. The retaining arm 313 is sandwiched between the first base 111 and the second base 121. The soldering arm 314 is exposed outside of the rear side of the housing 1. Referring to FIGS. 4 and 8, the conductive film 32 is much thinner than the side arm 31, e.g., the side arm being of $10^{-1}$ mm thickness vs. the conductive film being of $10^{-4}$~$10^{-5}$ mm. In this embodiment, the conductive film 32 is adhered to the surface of the second mating tongue 122 facing the first mating tongue 112. In this embodiment, a gap is formed between the first mating tongue 112 and the conductive film 32 after the first insulator 11 is assembled upon the second insulator 12 but before the third insulator 13 is applied thereupon. Therefore, the third insulator 13 will occupy the gap.

Figure 2:
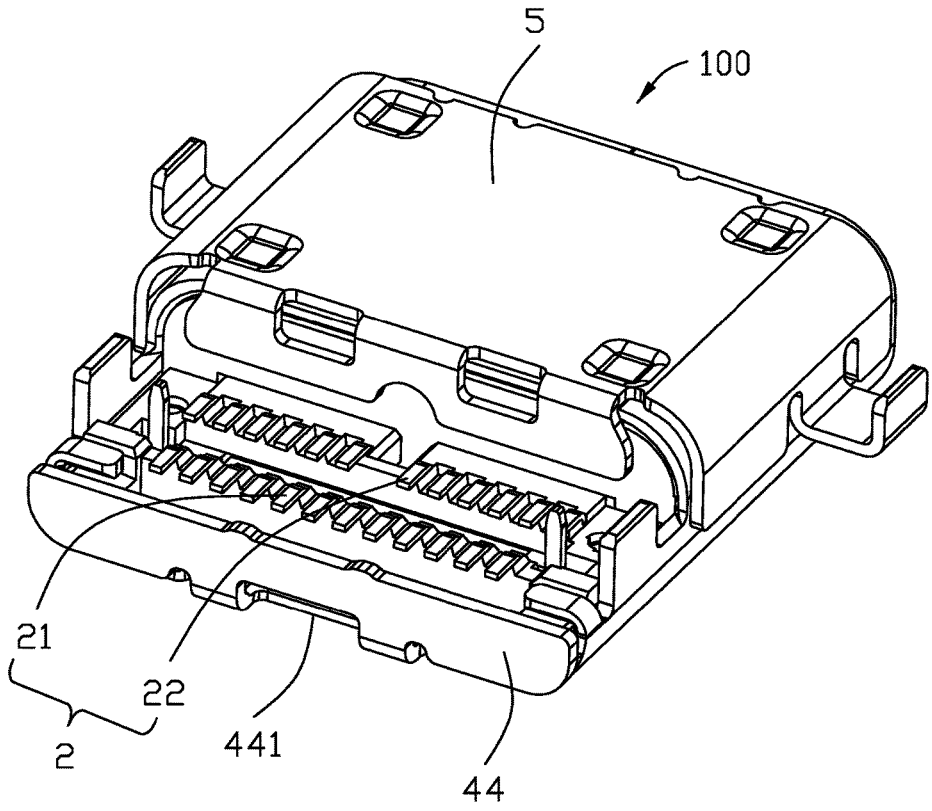
FIG. 2 is another perspective view of the electrical connector of FIG. 1.
Figure 3:
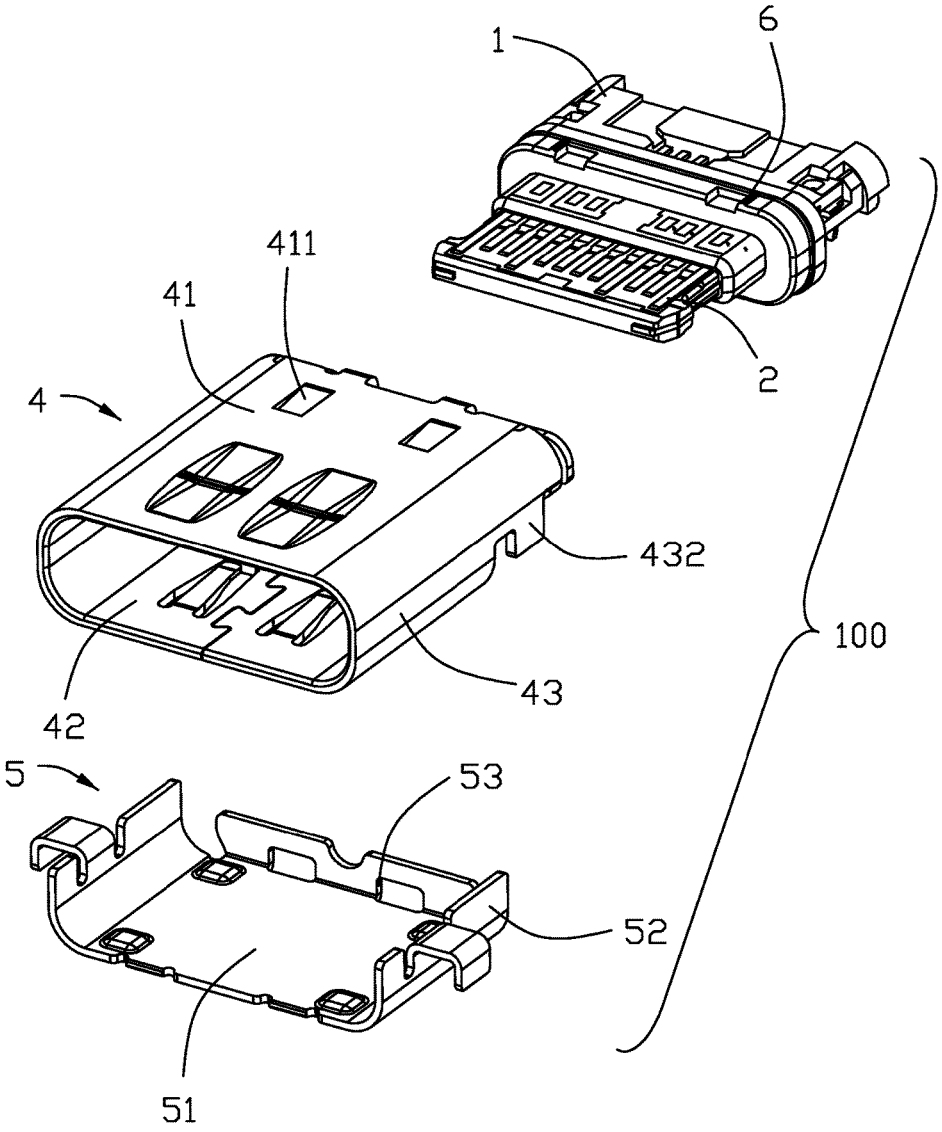
FIG. 3 is an exploded perspective view of the electrical connector of FIG. 1.

Referring to FIGS. 1-3, the metallic shield 4 includes opposite top wall 41 and bottom wall 42, and a pair of side walls 43 linked therebetween. Along the mating direction, the bottom wall 42 is shorter than the top wall 41. The top wall includes a pair of tabs 411 retained in the securing slots 135, respectively. The shield 4 further includes a rear wall 44 spaced from the side walls 43. The rear wall 44 for4 ms an opening 441 corresponding to the openings 114 and 124.

Referring to FIGS. 2-3, the bracket 5 includes a main board 51, and a pair of side boards 52 and a rear board 53 respectively extending from the main board 51. The rear board 53 covers the sealer 6.

The method of making the electrical connector 100 includes the following steps: Step 1) providing a first terminal module (not labeled) with a plurality of first contacts 21 embedded within the first insulator 11 via an insert-molding process, and a second terminal module (not labeled) with a plurality of second contacts 22 embedded within the second insulator 12 via another insert-molding process, and a reinforcement piece 3 including a conductive film 32 and a pair of side arms 31; Step 2) assembling the conductive film 32 upon the second insulator 12 and the side arms 31 by two sides of the conductive film 32; Step 3) assembling the first insulator 11 upon the reinforcement piece 3 wherein the first engaging device, i.e., the engaging block 126, extends into the corresponding second engaging device, i.e., the engaging hole 116, for securing the first insulator 11 and the second insulator 12 together with the reinforcement piece 3 therebetween in the vertical direction;

at the same time, the engaging blocks 123 located on two sides of the first insulator 11, the projections 125 are received within the corresponding recesses 115, and the first fixing post 118 and the second fixing post 128 extending into the corresponding second fixing hole 127 and first fixing hole 117; Step 4) applying a third insulator 13 upon the assembled first terminal module and second terminal module with the reinforcement piece 3 therebetween via another insert-molding process so as to form a complete terminal module assembly (not labeled) wherein all gaps among the first terminal module, the second terminal module and the reinforcement piece 3 may be occupied by material of the third insulator 13; Step 5) assembling the shield 4 upon the finalized terminal module assembly and assembling the bracket 5 upon the shield 4: Step 6) injecting glue into the opening 441 to have glue flow through the openings 114 and 124 so as to form the complete sealer 6 on the back of the connector 100.

The feature of the invention is to replace the unitary metallic shielding plate of the traditional connector with a pair of side arms and a conductive film therebetween wherein the side arm is thick and rigid while the conductive film is flexible and much thinner than the side arm with more than thousands times, and the conductive film is aligned with the corresponding power contacts and signal contacts while the side arms are aligned with the corresponding grounding contacts in the vertical direction. It is noted that on one hand, the relatively significant thin conductive film may provide the sufficient distance away from the corresponding power contacts in the vertical direction so as to avoid the shorting risk. In this embodiment, the distance between the conductive film and the power contacts in the vertical direction is around at least 0.20 mm (while preferred with 0.25 mm) compared with 0.175 mm of the traditional connector measured between the rigid/thick shielding plate and the power/signal contacts in the vertical direction. Simultaneously, the conductive film also provides sufficient shielding effect with regard to the differential signal contacts for EMI consideration. On the other hand, the rigid side arms may not only efficiently provide the required structural strength of the tongue portion for resisting bending moment applied thereto during mating but also the locking/grounding effect with the metallic deflectable latch of the complementary plug connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the conductive film may be replaced with a conductive coating/layer as long as the corresponding surface of the second insulator where the conductive film is adhered, provide a complete surface without openings therein so as not to contaminate the corresponding contacts. Also, the conductive film may be directly sandwiched between the first insulator and the second insulator without involvement with the third insulator in the vertical direction as long as the first insulator and the second insulator are properly arranged with each other. In this embodiment, the two opposite sides of the conductive film is pressed by the corresponding side arms in the vertical direction, respectively, as shown in FIG. 8. Anyhow,

What is claimed is:

1. An electrical connector comprising:

a terminal module assembly enclosing within a metallic shield, said terminal module assembly including:

a first terminal module with a plurality of first contacts embedded within a first insulator;

a second terminal module with a plurality of second contacts embedded within a second insulator; and the first insulator and the second insulator being secured to each other with a metallic reinforcement piece located therebetween in a vertical direction; wherein said reinforcement piece includes a conductive film and a pair of side arms in a transverse direction perpendicular to said vertical direction, said conductive film is thin and flexible while said side arms are rigid and much thicker than the conductive film.

2. The electrical connector as claimed in claim 1, wherein the first contacts includes a pair of grounding contacts aligned with the corresponding side arms in the vertical direction, respectively.

3. The electrical connector as claimed in claim 1, wherein the first contacts further includes a pair of power contacts and a pair of differential signal contacts both aligned with the conductive film in the vertical direction.

4. The electrical connector as claimed in claim 1, wherein the side arms press two opposite lateral sides of the conductive film in the vertical direction, respectively.

5. The electrical connector as claimed in claim 1, wherein a thickness of the conductive film is one thousandth of that of the side arm in the vertical direction.

6. The electrical connector as claimed in claim 1, wherein said conductive film is adhered to an interior surface of one of said first insulator and said second insulator.

7. The electrical connector as claimed in claim 1, wherein said side arm includes a solder leg exposed outside of a rear side of the housing.

8. The electrical connector as claimed in claim 1, further including a third insulator applied upon all the first terminal module, the second terminal module and the reinforcement piece to form a terminal module assembly.

9. The electrical connector as claimed in claim 8, wherein the first insulator, the second insulator and the third insulator commonly form an insulative housing categorized with a front tongue portion and a rear base portion along said front-to-back direction perpendicular to both said vertical direction and said transverse direction, and wherein the pair of side arms are exposed to opposite lateral sides of the front tongue portion in said transverse direction.

10. The electrical connector as claimed in claim 8, wherein the third insulator presses the conductive film in the vertical direction.

11. An electrical connector comprising:

a terminal module assembly enclosing within a metallic shield, said terminal module assembly including:

a first terminal module with a plurality of first contacts embedded within a first insulator, the first contacts including a pair of power contacts, a pair of grounding contacts and a pair of differential signal contacts;

a second terminal module with a plurality of second contacts embedded within a second insulator;

the first insulator and the second insulator being secured to each other with a metallic reinforcement piece located therebetween in a vertical direction; and a third insulator applied upon all the first terminal module, the second terminal module and the reinforcement piece to form a terminal module assembly; wherein said reinforcement piece includes a conductive film aligned with the corresponding power contacts and differential signal contacts in the vertical direction and distanced from the power contacts with a distance around at least 0.20 mm for high current delivery.

12. The electrical connector as claimed in claim 11, wherein said distance is at least 0.25 mm.

13. The method as claimed in claim 12, wherein a distance between the conductive film and the corresponding first contact or second contact in the vertical direction is not less than 0.25 mm.

14. The electrical connector as claimed in claim 11, wherein the reinforcement piece further includes a pair of side arms located by two sides of the conductive film and exposed upon two opposite lateral sides of the housing, and said side arms are much thicker and more rigid than the conductive film in the vertical direction.

15. The electrical connector as claimed in claim 14, wherein the pair of side arms are aligned with the pair of grounding contacts in the vertical direction, respectively.

16. The electrical connector as claimed in claim 14, wherein said third insulator engages both the conductive film and said pair of side arms.

17. A method of making an electrical connector comprising steps of:

providing a first terminal module with a plurality of first contacts retained in a first insulator via a first stage insert-molding process;

providing a second terminal module with a plurality of second contacts retained in a second insulator via another first stage insert-molding process;

providing a metallic reinforcement piece with a conductive film and a pair of side arms by two sides of the conductive film in a transverse direction wherein the conductive film is much more flexible and thinner than the side arms;

disposing the metallic reinforcement piece between the first terminal module and the second terminal module in a vertical direction perpendicular to said transverse direction.

18. The method as claimed in claim 17, further including a step of applying a third insulator upon all the first terminal module, the second terminal module and the reinforcement piece via a second stage insert-molding process.

19. The method as claimed in claim 18, wherein the first contacts includes a pair of grounding contacts aligned with the corresponding side arms in the vertical direction, respectively.

20. The method as claimed in claim 18, wherein the first contacts further includes a pair of power contacts and a pair of differential signal contacts both aligned with the conductive film in the vertical direction.

* * * * *